United States Patent [19]

Frielinghaus et al.

[11] 4,053,128

[45] Oct. 11, 1977

[54] JOINTLESS HIGH FREQUENCY TRACK CIRCUIT SYSTEMS FOR RAILROADS

[75] Inventors: Klaus H. Frielinghaus; Clinton S. Wilcox, both of Rochester, N.Y.

[73] Assignee: General Signal Corporation, Rochester, N.Y.

[21] Appl. No.: 748,024

[22] Filed: Dec. 6, 1976

[51] Int. Cl.[2] ..... B61L 23/22

[52] U.S. Cl. ..... 246/34 R; 246/37; 246/63 C

[58] Field of Search ..... 104/149, 150, 153; 246/34 R, 34 B, 34 CT, 35, 37, 63 R, 63 C

[56] References Cited

U.S. PATENT DOCUMENTS

| | | | |
|---|---|---|---|
| 3,501,629 | 3/1970 | Aiken | 246/34 R |
| 3,524,054 | 8/1970 | Smith | 246/34 R X |
| 3,794,833 | 2/1974 | Blazek et al. | 246/34 CT X |
| 3,949,959 | 4/1976 | Rhoton et al. | 246/34 CT |

*Primary Examiner*—Stephen G. Kunin

*Attorney, Agent, or Firm*—Harold S. Wynn; Milton E. Kleinman

[57] ABSTRACT

A stretch of railway track, has a high frequency track circuit transmitter and receiver and a cab signal transmitter coupled across track rails at each of several locations marking the ends of track sections along a stretch of railway track. Each location has an impedance bond having a primary winding connected across the track rails and having toroid secondary windings tuned to assigned distinctive high frequencies for coupling a track transmitter and a track receiver to the track rails. A loop circuit is also provided at each location, including a tuned loop, for inductively coupling a cab signal code transmitter to the track rails independent of the impedance bond. The tuned toroid coils and the loop circuit are connected in series to one end of a two wire line circuit, which, at its other end, is connected to a track circuit high frequency transmitteer, a track circuit receiver, and a cab signal transmitter connected in multiple.

2 Claims, 3 Drawing Figures

JOINTLESS HIGH FREQUENCY TRACK CIRCUIT SYSTEMS FOR RAILROADS

BACKGROUND OF THE INVENTION

This invention relates to high frequency jointless track circuits for railroads, and while the invention is subject to a wide range of applications, a preferred embodiment of the present invention will be particularly described as applied to a jointless high frequency track circuit system for a stretch of railway track for the detection of occupancy, and for the communication of cab signal controls from the wayside to vehicles passing through the stretch of track.

The present invention is an improvement over currently used jointless high frequency track circuit systems of the general character disclosed in the U.S. patent to W. R. Smith U.S. Pat. No. 3,524,054, issued Aug. 11, 1970. In the system according to this patent, distinctive frequencies are transmitted in adjoining track sections, high frequency transmitters and receivers of these frequencies being coupled to the track rails through impedance bonds having single coil primary windings on which tuned toroid secondary windings are provided for coupling the respective track occupancy detection transmitters and receivers to the track rails. By this arrangement, track circuit receivers are only responsive to the frequencies to which their toroid coils are tuned, and, although the same frequencies are used for more distinct track sections, there is no danger of a receiver being actuated by the same frequency of a distant track section because such frequency is attenuated by intervening shunting primary windings of impedance bonds which are not tuned to the associated frequency. This system of separation of transmitters having the same frequencies is not effective, however, for a cab signal frequency that is transmitted at each location solely for the control of cab signals in vehicles passing over the stretch of railway track. This is because the same cab signal frequency must be used in all track sections for transmission to vehicles passing therethrough, and all of the impedance bonds are tuned to this frequency. Therefore, each impedance bond couples a cab signal code transmitted to the track by a tuned toroid secondary winding which provides for transmission of high frequency cab signal energy equally in both directions from the associated location, although it may be desired to transmit only in one direction toward an approaching vehicle, on stretches of track having only one direction of traffic. Thus, because all impedance bonds are tuned to the cab signal frequency, there can be no attenuation of propagation of the frequency from one adjoining track section to the next as is discussed above where distinctive frequencies are assigned to adjoining track sections for occupancy detection purposes.

To induce enough current in the track rails for satisfactory operation of cab signals according to the system of the Smith patent could be costly because it would require the use of several toroid windings connected in multiple.

An object of the present invention is to provide jointless high frequency track circuit systems for communication of signals to rail vehicles having improvements which substantially obviate one or more of the limitations and disadvantages of the described prior system.

Another object of the present invention is to provide more efficient means for coupling high frequency cab signal energy to the track rails in systems where jointless track circuits are involved.

Other objects, purposes and characteristic features of the present invention will be in part obvious from the accompanying drawings and in part pointed out as the description of the invention progresses.

SUMMARY OF THE INVENTION

Jointless high frequency track circuit systems are provided for communication of signals through track rails of a stretch of railway track, the system having a high frequency track circuit transmitter and receiver and a cab signal transmitter coupled across the track rails at each of several locations marking the ends of track sections along a stretch of railway track. Coupling of the transmitters and receivers to the track rails is provided by an impedance bond having a low resistance primary winding shunting the track rails and providing a propulsion current return connection at its midpoint, the impedance bond having a plurality of secondary toroid coil windings inductively coupled to the primary winding for coupling a distinctive frequency transmitter and a distinctive frequency receiver respectively to the track rails for occupancy detection. The toroid coils are tuned to parallel resonance at the frequencies of the transmitter or receiver with which they are associated. A loop circuit is disposed at each location between the track rails and inductively coupled thereto along a portion extending near the impedance bond at that location, but not inductively coupled thereto, for coupling the cab signal transmitter to the track rails at one side or the other or on both sides of the impedance bond at the associated location, dependent upon the direction of traffic.

The loop circuits are materially less expensive than the use of several toroid windings in multiple as would be necessary according to the Smith patent.

For a better understanding of the present invention, together with other and further objects thereof, reference is had to the following description, taken in connection with the accompanying drawings, while its scope will be pointed out in the appending claims.

Figures 1, 2, 3:
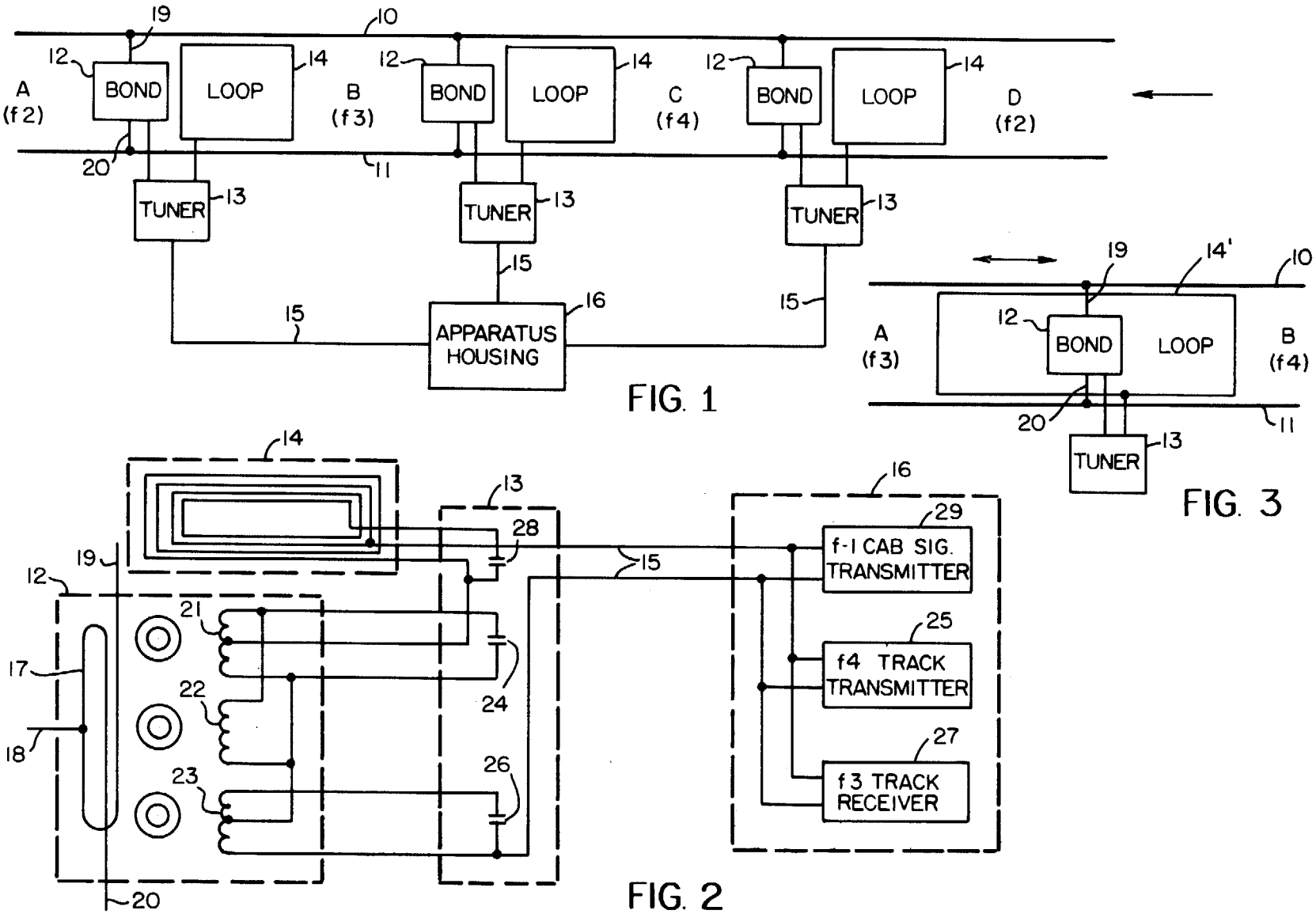
FIG. 1 is a block diagram of a jointless high frequency track circuit system for a stretch of railway track having a single direction of traffic according to a preferred embodiment of the present invention.
FIG. 2 is a schematic diagram illustrating typical connections for parallel resonance tuning of track circuit transmitters and receivers according to the preferred embodiment of the present invention.
FIG. 3 is a block diagram showing a modified form of a cab signal inductive loop at a typical location in a stretch of track that is considered to have traffic in both directions.

With reference to FIG. 1, a jointless high frequency track circuit system is illustrated for a stretch of railway track having running rails 10 and 11 that is divided into adjoining track sections, of which sections A, B, C and D are illustrated. The ends of the track sections are marked by impedance bonds connected across the track rails 10 and 11, each of the bonds 12 having associated therewith a tuner 13 and a loop circuit 14. The tuners 13 are connected by suitable line circuits 15 to an apparatus housing 16 that is provided for housing respective high frequency transmitters and receivers associated with the respective track sections. The frequencies f2, f3 and f4 are illustrated as being assigned to transmitters for track sections A, B, and C for occupancy detection, the frequency f1, to which the loop circuits 14 are tuned, being reserved for transmission of cab signal controls to vehicles passing through the stretch of trackway. It will be noted that distinctive frequencies are assigned to adjoining track sections for purposes that have been discussed in general and that will be hereinafter considered more in detail.

With reference to FIG. 2, the bond 12, tuner 13, and loop 14 for a typical location at the left-hand end of track section C are more specifically illustrated. The bond 12 has a primary winding 17 having a center tap 18 for a propulsion current return connection, and having leads 19 and 20 connected to rails 10 and 11 respectively as shown in FIG. 1. The bond 12 has three toroid windings 21, 22 and 23, the windings 21 and 22 being connected in multiple and tuned by a capacitor 24 in the tuner 13 to parallel resonance at a frequency *f*4 of track transmitter 25 contained in the apparatus housing 16 and connected to the tuner 13 over a two wire line circuit 15. The toroid winding 23 is tuned by a capacitor 26 to parallel resonance at a frequency *f*3 of track receiver 27 in the housing 16. The loop circuit 14 has an intermediate tap as do the toroid windings 21 and 23 and is similarly tuned to parallel resonance by a capacitor 28 at the frequency f1 of cab signal transmitter 29 in the apparatus housing 16. The transmitters 25 and 29 and the receiver 27 in the housing 16 are connected in multiple to the line circuit 15 at its right-hand end, while the tuned circuits at the left-hand end of line circuit 15 are connected in series across the two wire line circuit 15.

With reference to FIG. 3, a modified form of the invention is illustrated wherein a typical location at one end of a track circuit, such as the typical left-hand end of track section C of FIG. 1, is illustrated having similar apparatus to that shown in FIG. 1, except that the loop 14 of FIG. 1 has been modified to a larger loop 14' as shown in FIG. 3 to provide for transmission of the cab signal frequency f1 in both directions from the associated location. This form of the invention would be used on a railroad having traffic in both directions. In this form of the invention, the primary winding of the bond 12 functions the same as in FIG. 1 to restrict current flow from one track section to the adjoining track section.

In practice, the transmitters are coded on and off for further security against foreign current in the rails and for the communication of cab signalling information, the code rate being selected in accordance with the particular cab signal information to be communicated. The coders switch the cab signal transmitter 29 and the track transmitter 25 on alternately at each location. This mode of operation is more particularly disclosed, for example, in the General Railway Signal Bulletin No. A2816, published in October, 1974, which is incorporated herein by reference.

The stretch of trackway of FIG. 1 has its cab signal loop circuit 14 disposed to the right of the bonds 12 at respectively locations at the ends of the track circuits for transmission to westbound rail vehicles as they proceed along the trackway through the track sections with which the loop circuits 14 are associated. Because of the loop circuits 14 being parallel tuned to the frequency f1 of their associated cab signal transmitters 29, the effective impedance of the loops 14 as an element of the parallel tuned circuit is at a minimum, limited only by the D.C. resistance of the loops, thus providing maximum efficiency in inductively coupling the frequency *f*1 output of the cab signal transmitters 29 to the track rails 10 and 11.

Upon passage of a westbound vehicle through the track section C, for example, occupancy of this track section is registered by the shunting of the frequency *f*4 transmitted from the leaving end of the track section C so that the frequency *f*4 receiver (not shown) senses the shunting by the vehicle and registers occupancy. The cab signal transmitted energy induced in the track rails of section C at the left-hand end of this section through the loop 14 circulates through the track rails and the axles of the westbound vehicle, and this current induces a voltage in cab signal receiver windings disposed on the front of the vehicle over the track rails to communicate the particular code selected for transmission to the vehicle for control of its cab signals in the usual manner. The primary winding of the bond 12 at the left-hand end of the track section C serves as a shunting bar relative to the frequency *f*1 energy, because the bonds 12 are not tuned to this frequency, to materially attenuate propagation of this energy into the adjoining track section. Thus, transmission of energy through the track rails by a cab signal transmitter 29 at the frequency f1 is substantially limited to the particular track section with which the associated loop 14 is associated.

If the stretch of railway track has traffic in both directions and the loop circuit 14' is provided as is shown in FIG. 3, the system responds as if the single loop circuit 14' were divided into left-hand and right-hand loop portions at the left-hand and right-hand ends of the connection of the bond 12 to the track rails 10 and 11, thus limiting the transfer of f1 frequency energy from one track section to the next by the shunting of the primary windings 17 of the bonds 12.

Having thus described a jointless high frequency track circuit system as a preferred embodiment of the present invention, it is to be understood that various modifications and alterations may be made to the specific embodiment shown without departing from the spirit or scope of the invention.

What is claimed is:

1. A jointless high frequency track circuit system, for communication of signals through track rails of a stretch of railway track, having a high frequency track circuit transmitter and receiver and a cab signal transmitter coupled across the track rails at each of several locations marking the ends of track sections along a stretch of railway track wherein improved means for coupling the transmitters and receiver to the track rails at one location comprises; .

a. impedance bond means having a low resistance primary winding shunting the track rails and providing a propulsion current return connection at its midpoint, b. the impedance bond means having a plurality of toroid coil means inductively coupled to the primary winding for coupling a distinctive frequency transmitter and a distinctive frequency receiver to the track rails, c. tuning means for tuning each of the toroid coil means to substantially parallel resonance for maximum impedance across the track rails, d. loop circuit means disposed between the track rails and inductively coupled thereto along a portion extending near the impedance bond means but not inductively coupled thereto for coupling the cab signal transmitter at a distinctive frequency to the track rails, e. an apparatus housing at a remote point relative to the bond means, loop means, and tuning means for housing the track circuit code transmitter, the receiver and the cab signal transmitter of at least said one location, and f. circuit means including a line circuit having only two line wires for connecting the track circuit code transmitter and receiver and the cab signal transmitter for said one location to one end of the line circuit in multiple, the other end of the line circuit being connected to the toroid windings and the loop circuit means in series.

2. A jointles high frequency track circuit system according to claim 1 wherein the loop circuit means comprises a tuned loop within which the impedance bond means is disposed, whereby the loop circuit is inductively coupled to the track rails of the track sections on both sides of the impedance bond means.

* * * * *